US009102466B2

(12) United States Patent
Neufeldt

(10) Patent No.: US 9,102,466 B2
(45) Date of Patent: Aug. 11, 2015

(54) WASTE COLLECTION VEHICLE WITH BUCKET DRIVE MECHANISM

(75) Inventor: Dennis Neufeldt, Coaldale (CA)

(73) Assignee: Haul-All Equipment Ltd., Lethbridge, Alberta (CA)

( * ) Notice: Subject to any disclaimer, the term of this patent is extended or adjusted under 35 U.S.C. 154(b) by 705 days.

(21) Appl. No.: 13/342,100

(22) Filed: Jan. 1, 2012

(65) Prior Publication Data

US 2013/0170932 A1 Jul. 4, 2013

(51) Int. Cl.

| | |
|---|---|
| ***B65F 3/08*** | (2006.01) |
| ***B65F 3/00*** | (2006.01) |
| ***B65F 3/26*** | (2006.01) |
| ***B65F 3/20*** | (2006.01) |

(52) U.S. Cl.

CPC . *B65F 3/001* (2013.01); *B65F 3/08* (2013.01); *B65F 3/205* (2013.01); *B65F 3/207* (2013.01); *B65F 3/26* (2013.01)

(58) Field of Classification Search

CPC ..... B65F 3/02; B65F 3/208
USPC ..... 414/409, 425, 493, 525.5, 652, 653, 414/656, 424

See application file for complete search history.

(56) References Cited

U.S. PATENT DOCUMENTS

| | | | | | |
|---|---|---|---|---|---|
| 2,417,696 | A | * | 3/1947 | Linde | 414/303 |
| 2,456,434 | A | * | 12/1948 | Manthie | 414/546 |
| 2,674,384 | A | * | 4/1954 | Galloway | 414/541 |
| 3,148,793 | A | * | 9/1964 | Walter | 414/409 |
| 3,152,707 | A | | 10/1964 | Rey | |
| 3,232,463 | A | | 2/1966 | Weir | |
| 3,452,891 | A | * | 7/1969 | Wilson et al. | 414/409 |
| 3,484,006 | A | | 12/1969 | Burke | |
| 3,658,199 | A | * | 4/1972 | Owen, Jr. | 414/425 |
| 3,709,388 | A | | 1/1973 | Neufeldt | |
| 4,057,154 | A | | 11/1977 | Neufeldt | |
| 4,096,959 | A | * | 6/1978 | Schaffler | 414/408 |
| 4,103,790 | A | | 8/1978 | Neufeldt | |
| 4,260,316 | A | | 4/1981 | Gollnick | |
| 4,406,573 | A | | 9/1983 | Colin | |
| 4,453,879 | A | | 6/1984 | Kelley et al. | |
| 4,473,333 | A | | 9/1984 | Stuart | |
| 4,786,228 | A | | 11/1988 | Mazzocchia et al. | |
| 4,992,019 | A | | 2/1991 | Behling et al. | |
| 5,316,430 | A | | 5/1994 | Horning et al. | |
| 5,344,273 | A | * | 9/1994 | Radlein | 414/409 |
| 5,427,496 | A | * | 6/1995 | Ratledge et al. | 414/525.2 |

(Continued)

FOREIGN PATENT DOCUMENTS

| | | |
|---|---|---|
| CA | 2074405 | 1/1994 |

*Primary Examiner* — James Keenan
(74) *Attorney, Agent, or Firm* — O'Shea Getz P.C.

(57) ABSTRACT

A waste collection vehicle, such as a garbage truck, recycling truck or organic waste collection truck, has a bucket drive mechanism. The vehicle has a waste container that houses a bin and a movable bucket for receiving waste. The movable bucket is driven upwardly in sliding contact with a divider wall of the bin by the bucket drive mechanism. The bucket drive mechanism further causes the bucket to rotate about a pivot for transferring waste from the bucket into the bin. A rotatable paddle may be provided for sweeping the waste from the bucket and for compacting the waste inside the bin. The bucket drive mechanism may include inclined actuators eccentrically connected to sliding collars that run over guide rails to raise the bucket until the sliding collars reach a horizontally disposed rocker shaft that acts as a pivot for pivoting the bucket.

24 Claims, 3 Drawing Sheets

(56) References Cited

U.S. PATENT DOCUMENTS

| | | | | |
|---|---|---|---|---|
| 5,584,642 | A * | 12/1996 | Huntoon | 414/525.2 |
| 5,813,818 | A | 9/1998 | McNeilus et al. | |
| 5,857,822 | A | 1/1999 | Christenson | |
| 5,931,628 | A | 8/1999 | Christenson | |
| 7,588,408 | B2 * | 9/2009 | Tomassoni | 414/513 |
| 7,997,852 | B1 | 8/2011 | Campbell et al. | |
| 2005/0053452 | A1 * | 3/2005 | Tomassoni | 414/525.5 |
| 2005/0063807 | A1 | 3/2005 | Martin et al. | |
| 2005/0135910 | A1 | 6/2005 | Pruteanu et al. | |
| 2005/0158160 | A1 | 7/2005 | Johnson et al. | |
| 2009/0067965 | A1 | 3/2009 | Martin et al. | |

* cited by examiner

WASTE COLLECTION VEHICLE WITH BUCKET DRIVE MECHANISM

CROSS-REFERENCE TO RELATED APPLICATIONS

This is the first application filed for the present technology.

TECHNICAL FIELD

The present technology relates generally to waste collection vehicles and, in particular, to garbage trucks having movable buckets.

BACKGROUND

Waste collection vehicles such as garbage trucks are used to collect garbage, refuse, waste or other such material. Waste collection vehicles typically compact the waste to maximize the amount of waste that can be collected before having to dump the waste. Various compaction systems are known in the art. Some compaction systems utilize a bucket into which waste is loaded. The waste is transferred from the bucket into a bin. The waste may be compacted in the bin using a compaction mechanism. One recurring issue with some bucket systems is that some waste may fall between the bucket and the bin during the transfer. Another issue is the requirement to modify the chassis frame to achieve a low loading height. Restrictions governing modifications are becoming more and more onerous and the costs of making such modifications are increasing accordingly. Therefore, a more effective mechanism for transferring waste from the bucket to the bin would be highly desirable.

SUMMARY

In general, the present invention provides a material collection vehicle such as a waste collection vehicle, garbage truck, recycling truck or organic waste disposal vehicle. The vehicle has a bucket which rises and then pivots to transfer waste or other material into a bin. The bucket maintains sliding contact with the divider wall while it rises to prevent waste or other debris from falling between the bucket and the divider wall of the bin. A rotatable packing paddle may be provided to sweep waste (or other material) from the bucket when the bucket has been pivoted and to also pack or compact the waste (or other material) in the bin.

Thus, an aspect of the present invention is a material collection vehicle that includes a frame and a container mounted to the frame. The container houses a bin and a movable bucket for receiving material such as waste. The movable bucket is driven upwardly in sliding contact with a divider wall of the bin by a bucket drive mechanism. The bucket drive mechanism further causes the bucket to rotate about a pivot for transferring the material from the bucket into the bin. The vehicle further includes a rotatable paddle for sweeping the material from the bucket and for compacting the material inside the bin.

Another aspect of the present invention is a waste collection vehicle that includes a frame for supporting an engine, a transmission system, a plurality of wheels and a cab. The truck further includes a waste container pivotally mounted to the frame, the container being movable from a generally horizontal posture for loading and carrying waste and a generally inclined posture for dumping the waste through a rear tailgate, the container having a bin for waste and a movable bucket for receiving waste through one or more side-loading ports in side walls of the container and for transferring the waste into the bin. The truck further includes a bucket drive mechanism for raising the bucket while maintaining sliding contact between the bucket and a divider wall of the bin and for pivoting the bucket for transferring the waste into the bin.

Yet another aspect of the present invention is a method of collecting material such as waste in a truck. The method entails receiving the material in a bucket through a side-loading port in a container, raising the bucket while maintaining sliding contact between the bucket and a divider wall of a bin housed within the container, and rotating the bucket to dump the material into the bin.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

In general, a waste disposal vehicle has a frame and a container mounted to the frame. The container houses a bin which serves as a compartment for waste, garbage, refuse or other such material (hereinafter referred to generically as the "material"). This material is transferred from a movable loading bucket into the bin. A side wall of the container may include a side-loading port through which the material is loaded into the loading bucket. The movable bucket is driven upwardly in sliding contact with a divider wall of the bin by a bucket drive mechanism. The bucket drive mechanism then causes the bucket to rotate (pivot) about a pivot for transferring the material into the bin. The vehicle may include a packing paddle for sweeping the material from the bucket and for compacting (packing) the material in the bin.

Figure 1:
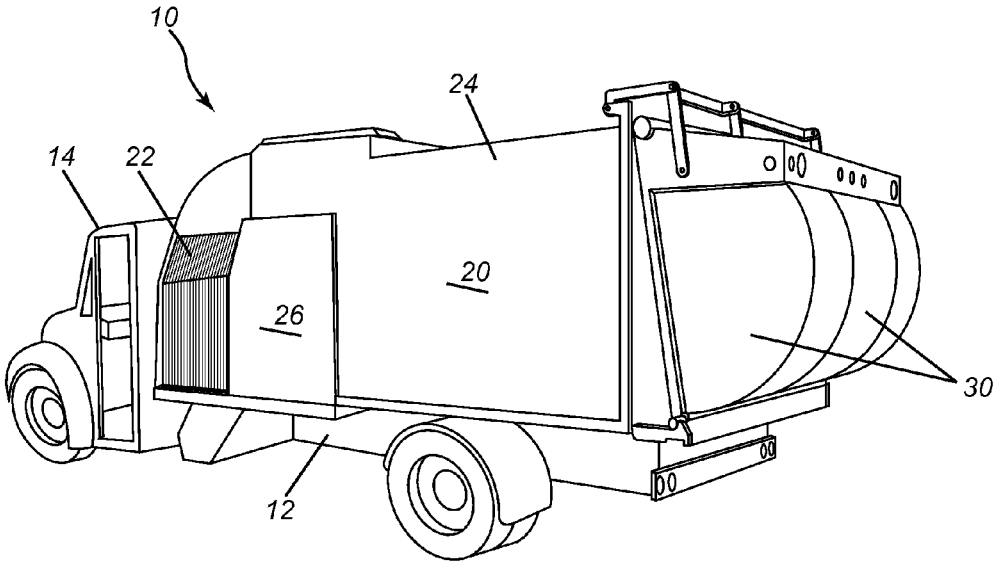
FIG. 1 is an isometric view of garbage truck incorporating a bucket drive compaction system in accordance with an embodiment of the present invention.

FIG. 1 is an isometric view of a garbage truck incorporating a bucket drive mechanism in accordance with an embodiment of the present invention. The garbage truck is one example of a waste disposal vehicle or waste collection vehicle. The bucket drive mechanism may be used in other types of waste disposal vehicles such as recycling trucks or organic waste collection trucks. The bucket drive mechanism may also be used in vehicles designed to collect and compact any other form of compatible material or compressible substance, even if the material or substance is not waste material or recyclable material.

Figure 2:
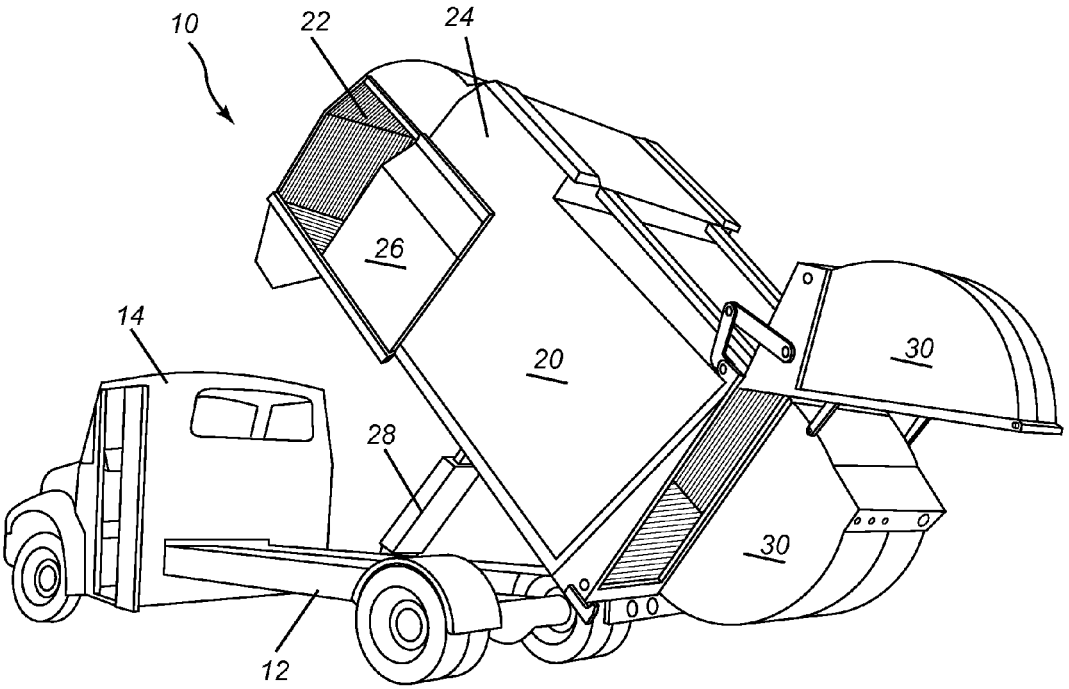
FIG. 2. is an isometric view of the garbage truck with its container in a pivoted posture for dumping.

As depicted by way of example in FIG. 1, a waste disposal vehicle, which is generally designated by reference numeral 10, includes a frame (or chassis) 12. The frame supports an engine, which may be mounted to a front portion of the frame. The engine may be an internal combustion engine such as a 4-stroke diesel engine or gas engine but it may also be a hybrid electric engine or an electric motor with a battery or capacitor pack. It should be appreciated that any type of engine, motor or propulsion system may be employed. The engine provides power to drive hydraulic systems to raise (or pivotally raise) a container 20 as illustrated in FIG. 2 and also to drive the bucket drive mechanism and packing paddle, and as will be described in greater detail below. The vehicle 10 depicted by way of example in FIG. 1 also includes a cab 14. The vehicle also includes a transmission system for driving one or more axles of the vehicle. The vehicle is shown as having two axles with two front wheels and two pairs of wheels for supporting the weight of the container although the vehicle may have any other number of axles or wheels. The vehicle may, of course, include other systems, subsystems and components not explicitly described herein, such as a braking system, steering system, electrical system, heating and air conditioning systems, etc.

As further depicted by way of example in FIG. 1, the container 20 may have side-loading ports 22 on one or both sides of the container. Dual side loading enhances routing flexibility because the container can be loaded from both sides. The side-loading ports 22 may be openings in the side walls 24 of the container. A sliding door 26 may be provided to cover each side-loading port 22 when the vehicle 10 is not collecting waste or other material. Any other type of doors (hinged doors, roll-down doors, shutters, etc.) may also be used. These doors may be manually displaced or, alternatively, they may be automatically powered by a hydraulic, pneumatic or electric system. It should also be noted that the vehicle does not absolutely require doors, although doors should be provided as the doors are useful to keep material from blowing out of the vehicle and also to improve the aesthetics and aerodynamics of the vehicle.

As further depicted by way of example in FIG. 1, the cab 14 may have dual steering wheels. A dual steering stand-up cab enables the operator to drive the vehicle from whichever side of the cab is more convenient.

FIG. 2 illustrates the vehicle with its container 20 pivoted into a dumping posture. The container 20 may be pivotally raised using one or more hydraulic actuators 28 mounted to the frame and an underside of the container as shown by way of example in FIG. 2. The hydraulic actuator(s) 28 may be controlled from inside the cab 14. To dump waste or other material from the container 20, the rear tailgate 30 must be opened as shown in FIG. 2. The opening of the rear tailgate 30 may also be hydraulically actuated by a control inside the cab.

The rear tailgate 30 may be a liquid-tight, self-locking tailgate such as a shown by way of example in FIG. 2. The tailgate 30 may be pivotally mounted to a top portion of the container 20. In the specific embodiment illustrated in FIG. 2, the vehicle has two separate tailgates that can be opened and closed separately (independently). In this embodiment, each tailgate covers a separate bin (compartment) within the container. For example, the container may comprise a left-side bin and a right-side bin. In this embodiment, there may be a two side-by-side buckets for each of the side-by-side bins or, in other embodiments, there may be a single bucket with a single bin. The vehicle can thus have a single compartment or dual compartments. In embodiments with dual compartments, there may be only a single packing mechanism for both compartments although, in other embodiments, there may two packing mechanisms.

The structure, design and operation of the bucket drive mechanism will now be described with reference to the sequential illustrations of FIGS. 3-6.

Figure 3:
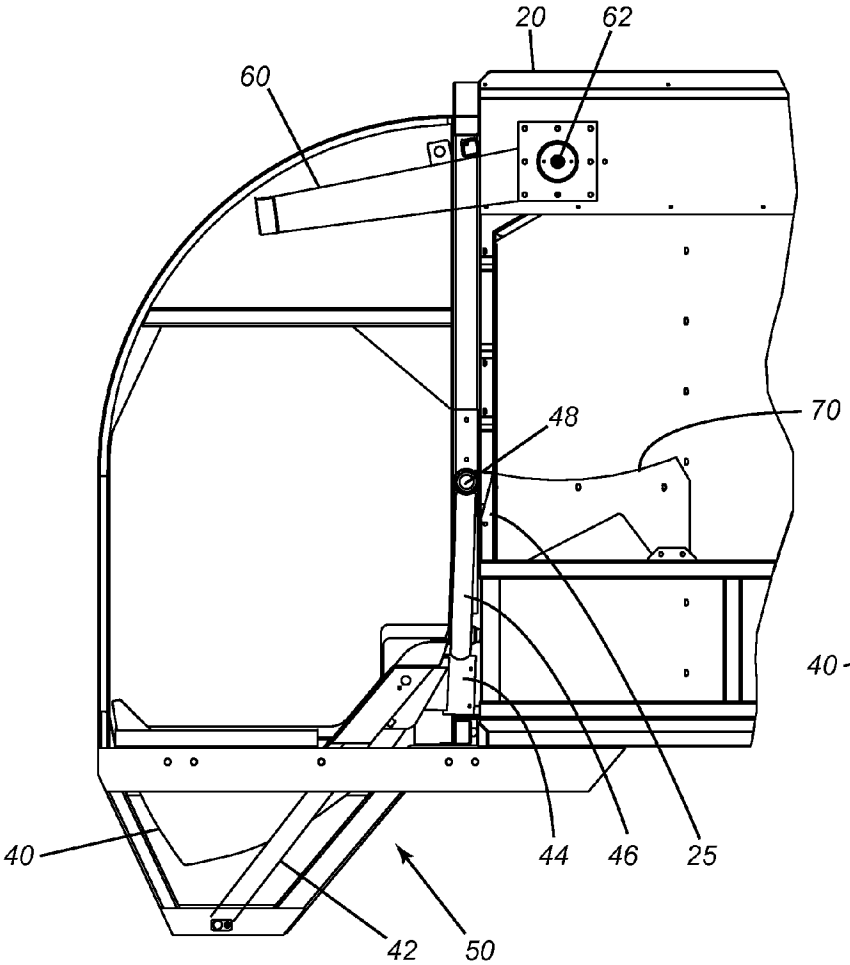
FIG. 3 is a side elevation view of a bucket drive compaction system, showing the bucket down in its loading position.
Figure 6:
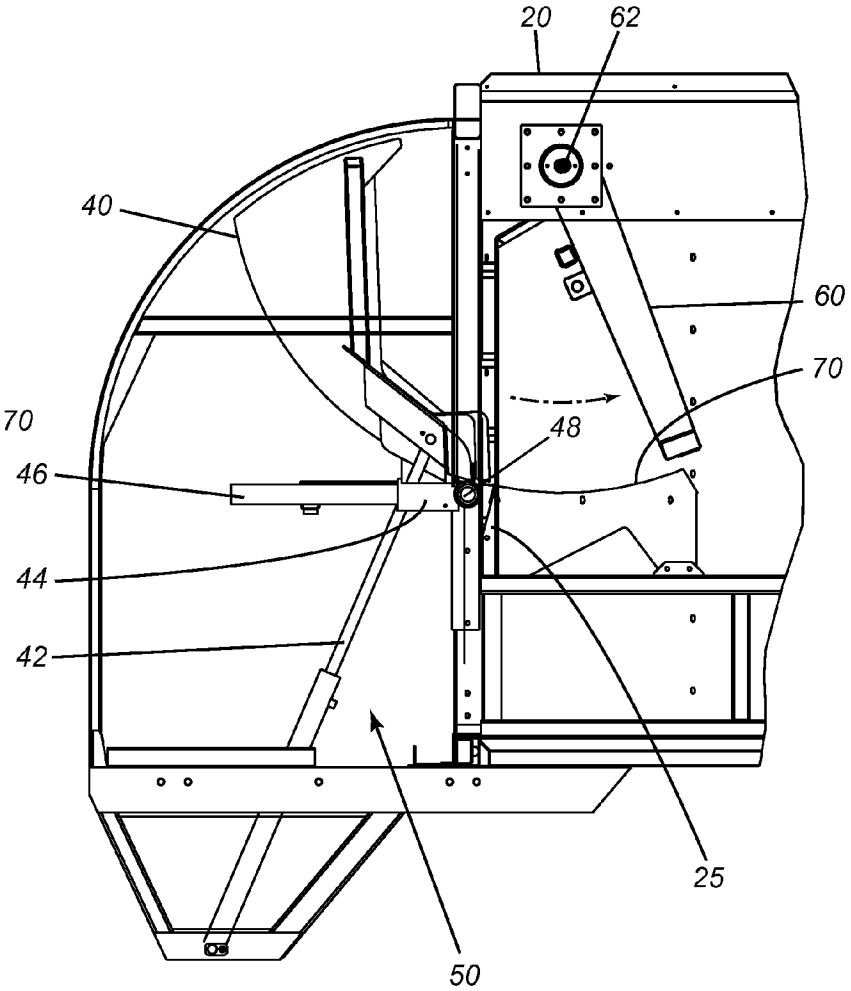
FIG. 6 is a side elevation view of the bucket drive compaction system, showing the bucket at its top, fully rotated position and the paddle fully in a packing position.

FIG. 3 is a side elevation view of a divider portion of the container 20. The divider portion of the container 20 houses a bucket (or loading bucket) 40 and a bucket drive mechanism 50 for moving the bucket. FIG. 3 shows the bucket down in its loading position. Waste or other material is manually loaded into the loading bucket by the operator. As shown by way of example in FIG. 3, the bucket is driven initially in a generally vertical direction by a pair of inclined hydraulic actuators (also referred to as bucket cylinders) 42. The bucket is connected to a pair of sliding collars (sleeves) 44 that each slide over a respective guide rail 46 (rod, pipe or other guide element). The two guide tails (pipes or rods) 46 are generally vertically disposed and parallel to one another in the initial posture shown in FIG. 3 and in FIG. 4. These guide rails then rotate as shown in FIG. 5 and FIG. 6.

Figure 4:
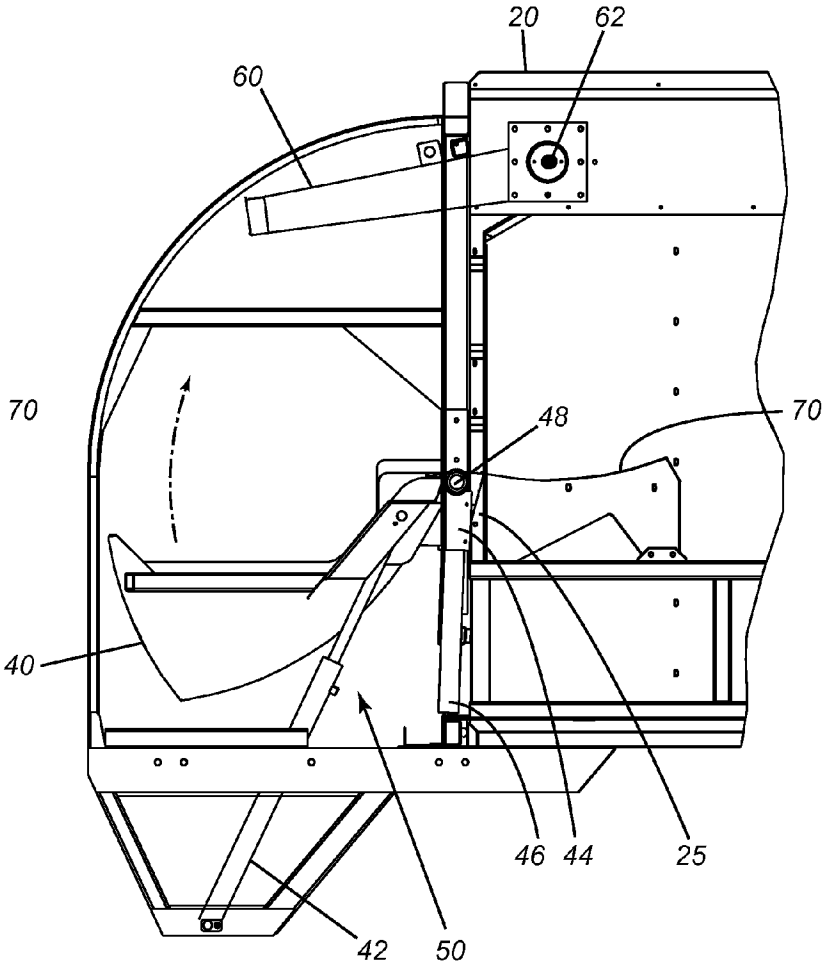
FIG. 4 is a side elevation view of the bucket drive compaction system, showing the bucket rising before rotation.

FIG. 4 shows the bucket 40 raised from the lower (loading) position to an upper (raised) position just prior to rotation. The twin inclined hydraulic actuators 42 provide the motive power for the bucket drive. These inclined parallel actuators 42 drive the bucket 40 upwardly while maintaining sliding contact between the bucket 40 and the divider wall 25 of the bin. It is desirable that the bucket maintain a sliding contact with the divider wall of the bin for substantially the entire distance that the bucket traverses as it rises from its lower position to its upper position. This sliding contact effectively forms a seal between the bucket and the divider wall, thus preventing waste from falling between the bucket and the bin. Because there is no gap (or least a very insubstantial gap) between the bucket and the divider wall, substantially no waste (or other material) becomes lodged between the bucket and the divider wall of the bin. In another embodiment, the bucket does not actually contact the divider wall but slides in close proximity to the divider wall. For example, in one embodiment, the bucket slides in close proximity to the divider wall such that the gap between the bucket and divider wall is no more than 0.1 mm. In another embodiment, the gap is no more than 1 mm. In yet another embodiment, the gap is no more than 1 cm. A small gap may be tolerated for certain types of materials where the size or granularity of the material is such that it cannot fall into the gap, i.e. it would fit between the bucket and the divider wall. For example, when collected aluminum soft drink cans, a gap of 1 cm would be adequate because no aluminum can could fall into such a small gap.

The bucket slides have a semi-circular (half-moon) upper surface that engages the underside of a rocker shaft (which may be a substantially horizontal pivot pipe) 48. As will be described below in greater detail, the rocker shaft 48 acts as a pivot around which the bucket 40 pivots when the actuators attempt to push the slides and bucket further upwardly. Further actuation by the actuator thus causes the bucket 40 to rotate about the rocker shaft 48 as shown in FIG. 5.

Figure 5:
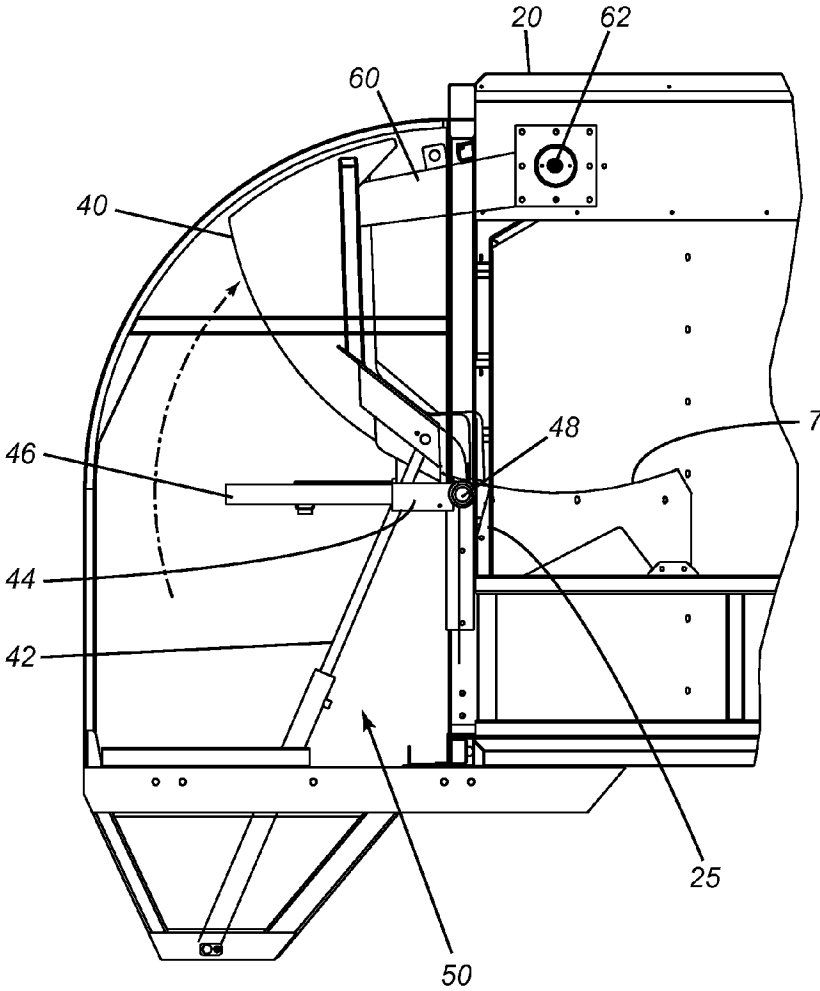
FIG. 5 is side elevation view of the bucket drive compaction system, showing the bucket at its top, fully rotated position and the paddle in a start position.

FIG. 5 shows the bucket at its top, fully rotated position and a packing paddle 60 in a start position. In one embodiment, actuation of the paddle is automatic once the bucket has pivoted into the position shown in FIG. 5. Automatic actuation of the paddle may be accomplished, for example, using a contact switch or a sensor that detects the position of the bucket and sends a signal to a controller that, in turn, causes the paddle to be actuated. Alternatively, a manually operated paddle may be provided, requiring the operator to depress a button or other switch to move the paddle. Such a button would then be deactivated when the bucket is in any other position. Alternatively, a mechanical linkage may be used to engage an actuation mechanism for actuating (rotating) the paddle.

FIG. 6 shows the bucket 40 at its top, fully rotated position and the paddle 60 fully in a packing position. In the specific embodiment illustrated in FIG. 6, the guide surface 70 at the entrance of the bin is upwardly curved. This guide surface has a curvature that substantially matches that of the bottom surface of the bucket. The paddle 60 rotates about the paddle pivot 62 to define a radius that matches this curvature. In other words, the paddle 60 sweeps along the inside of the bucket 40 and along the upwardly curved guide surface 70. This guide surface 70 helps to ensure that trash or waste is swept fully into the bin, i.e. beyond the threshold or entrance of the bin.

The packing paddle shown by way of example in the figures may be varied in other embodiments. For example, the packing paddle may sweep through an arc that is greater than or less than the arc defined by the starting position of FIG. 5 and the fully swept position of FIG. 6. The packing paddle may remain in the position shown in FIG. 6 for a predetermined period of time, after which it returns automatically to the initial position of FIG. 5. In another embodiment, the return may be controlled by the operator pressing a button, switch or control element. Although in the embodiment depicted in FIGS. 3-6, the packing paddle has a tapered profile, any other shape of paddle may be employed provided it has sufficient clearance when sweeping through its arc.

The packing paddle 60 (or scraper or sweeper) may be driven by any suitable mechanical means capable of exerting a torque on the paddle such as a hydraulic motor. In one embodiment, the paddle is driven (rotated) by two hydraulic cylinders although, in other embodiments, the paddle may be rotated by one cylinder or even more than two cylinders. Alternatively, the paddle may be actuated by pneumatic actuators or by electric motors with suitable reduction gears, chain and sprocket, or any other suitable torque-transmission mechanism etc.

During collection the operator manually loads the material (such as, for example, garbage or other waste) into the bucket. Once loading of the material into the loading bucket is completed, the operator activates the compaction system, for example, by pressing a button or switch or by actuating a lever. This button/switch/lever may be disposed on the side of the container and/or it may be disposed inside the cab. The actuators raise the bucket until the slides of the bucket contact the rocker shaft. During the ascension of the bucket, the forward wall of the bucket abuts the divider wall of the bin. In other words, the bucket remains in sliding contact with the wall of the bin to ensure that there is no gap between the bucket and wall into which debris or waste may fall. One advantage of this mechanism is therefore that it prevents debris or waste from falling between the bucket and the divider wall of the bin. The bucket then rotates about the rocker shaft to dump waste or other material into the bin. The packing paddle then pushes or scrapes any waste or other material remaining in the bucket from the bucket into the bin. The packing paddle continues to rotate into the bin, thereby packing (compacting) the waste or other material in the bin.

Although the bucket drive mechanism is designed primarily for a waste collection vehicle, the mechanism may be incorporated into any other vehicle that collects a compatible material.

This invention has been described in terms of specific examples, embodiments, implementations and configurations which are intended to be exemplary only. Persons of ordinary skill in the art will appreciate that obvious variations, modifications and refinements can be made to the embodiments disclosed herein without departing from the inventive concept(s) presented herein. The scope of the exclusive right sought by the Applicant is therefore intended to be limited solely by the appended claims.

The invention claimed is:

1. A material collection vehicle comprising:

a frame;

a container mounted to the frame, the container housing a bin and a movable bucket for receiving material, the movable bucket being driven upwardly in sliding contact with a substantially flat and vertical divider wall of the bin by a bucket drive mechanism such that there is substantially no gap between the bucket and the divider wall to thereby prevent material from falling between the bucket and the divider wall, the bucket drive mechanism further causing the bucket to rotate about a pivot for transferring the material from the bucket into the bin; and a rotatable paddle for sweeping the material from the bucket and for compacting the material inside the bin.

2. The vehicle as claimed in claim 1 wherein the bucket drive mechanism comprises:

substantially upright guide rails mounted along the divider wall of the bin;

a pair of parallel inclined hydraulic actuators connected at a bottom end to a bottom portion of the container and at a top end to the bucket; and a pair of sliding collars connected to the bucket, the sliding collars being dimensioned to slide over the guide rails for moving the bucket.

3. The vehicle as claimed in claim 2 wherein the actuators are connected eccentrically to the bucket, with an offset between the sliding collars and the actuators such that actuation of the actuators causes the bucket to rise by sliding over the guide rails until the bucket reaches the pivot at which point further actuation of the actuators causes the bucket to rotate about the pivot to thereby dump the material from the bucket into the bin.

4. The vehicle as claimed in claim 3 wherein the pivot comprises a rocker shaft and wherein the sliding collars each comprises an upper end presenting a semi-circular upper profile for engaging the rocker shaft and for enabling the sliding collars to pivot about the rocker shaft.

5. The vehicle as claimed in claim 2 wherein the rails are rotatable with the sliding collars and the bucket.

6. The vehicle as claimed in claim 1 wherein the rotatable paddle is mounted to an upper portion of the container and is driven by at least one hydraulic actuator to sweep in an arc that follows a curvature of an inside surface of the bucket.

7. The vehicle as claimed in claim 6 comprising an upwardly curved guide surface inside the bin, the upwardly curved guide surface having a curvature matching that of the inside surface of the bucket.

8. The vehicle as claimed in claim 1 further comprising a self-locking liquid-tight tailgate that opens when the container is pivoted into a dumping posture.

9. A waste collection vehicle comprising:

a frame for supporting an engine, a transmission system, a plurality of wheels and a cab;

a waste container pivotally mounted to the frame behind the cab, the container being movable from a generally horizontal posture for loading and carrying waste and a generally inclined posture for dumping the waste through a rear tailgate, the container having a bin for the waste and a movable bucket for receiving the waste through one or more side-loading ports in side walls of the container and for transferring the waste into the bin; and a bucket drive mechanism for raising the bucket while maintaining sliding contact between the bucket and a substantially flat and vertical divider wall of the bin such that there is substantially no gap between the bucket and the divider wall to thereby prevent the waste from falling between the bucket and the divider wall, and for pivoting the bucket for transferring the waste into the bin.

10. The vehicle as claimed in claim 9 further comprising a rotatable paddle for sweeping the waste from the bucket and for compacting the waste into the bin.

11. The vehicle as claimed in claim 10 wherein the bucket drive mechanism comprises:

guide rails mounted to the divider wall of the bin;

a pair of parallel inclined actuators connected at a bottom end to a bottom portion of the container and at a top end to the bucket; and a pair of sliding collars connected to the bucket, the sliding collars being dimensioned to slide over the guide rails for moving the bucket.

12. The vehicle as claimed in claim 10 wherein the rotatable paddle is mounted to an upper portion of the container and is driven by at least one hydraulic actuator to sweep in an arc that follows a curvature of an inside surface of the bucket.

13. The vehicle as claimed in claim 12 comprising an upwardly curved guide surface inside the bin, the upwardly curved guide surface having a curvature matching that of the inside surface of the bucket.

14. The vehicle as claimed in claim 9 wherein the bucket drive mechanism comprises:

guide rails mounted to the divider wall of the bin;

a pair of parallel inclined actuators connected at a bottom end to a bottom portion of the container and at a top end to the bucket; and a pair of sliding collars connected to the bucket, the sliding collars being dimensioned to slide over the guide rails for moving the bucket.

15. The vehicle as claimed in claim 14 wherein the actuators are connected eccentrically to the bucket, with an offset between the sliding collars and the actuators such that actuation of the actuators causes the bucket to rise by sliding over the guide rails until the bucket reaches a pivot that causes the bucket to rotate.

16. The vehicle as claimed in claim 15 wherein the pivot comprises a substantially horizontal rocker shaft and wherein the sliding collars each comprises an upper end presenting a semi-circular upper profile for engaging the rocker shaft and for enabling the sliding collars to pivot about the rocker shaft.

17. The vehicle as claimed in claim 14 wherein the rails are rotatable with the sliding collars and the bucket.

18. The vehicle as claimed in claim 9 further comprising a self-locking liquid-tight tailgate that opens when the container is pivoted into a dumping posture.

19. A method of collecting material in a vehicle, the method comprising:

receiving the material in a bucket through a side-loading port in a container;

raising the bucket while maintaining sliding contact between the bucket and a substantially flat and vertical divider wall of a bin housed within the container such that there is substantially no gap between the bucket and the divider wall to thereby prevent the material from falling between the bucket and the divider wall; and rotating the bucket to dump the material into the bin.

20. The method as claimed in claim 19 further comprising rotating a packing paddle to sweep the material from the bucket and to compact the material in the bin.

21. The method as claimed in claim 20 wherein raising the bucket comprises driving the bucket using inclined hydraulic actuators eccentrically connecting the container to the bucket via offset slide collars.

22. The method as claimed in claim 21 wherein rotating the bucket comprises actuating the actuators to cause the slide collars to pivot about a rocker shaft disposed substantially horizontally along the divider wall of the bin.

23. The method as claimed in claim 19 wherein raising the bucket comprises driving the bucket using inclined hydraulic actuators that cause sliding collars affixed to the bucket to slide over guide rails.

24. The method as claimed in claim 23 wherein rotating the bucket comprises further actuating the bucket to cause the sliding collars and the bucket to pivot about a pivot axis defined by a substantially horizontal shaft.

* * * * *